US007604828B2

(12) United States Patent
Taylor et al.

(10) Patent No.: US 7,604,828 B2
(45) Date of Patent: Oct. 20, 2009

(54) EASY-OPEN SAUSAGE PACKAGE

(75) Inventors: Guy R. Taylor, Chicago, IL (US); Rodney J. Simpson, Batavia, IL (US)

(73) Assignee: ConAgra Foods RDM, Inc., Omaha, NE (US)

( * ) Notice: Subject to any disclaimer, the term of this patent is extended or adjusted under 35 U.S.C. 154(b) by 708 days.

(21) Appl. No.: 11/120,421

(22) Filed: May 2, 2005

(65) Prior Publication Data

US 2006/0246185 A1 Nov. 2, 2006

(51) Int. Cl.
*B65B 25/06* (2006.01)

(52) U.S. Cl. ..... 426/129; 426/106; 426/112; 383/210; 383/211

(58) Field of Classification Search ..... 426/106, 426/119, 130, 122, 105, 108, 112, 127, 129; 383/205, 5, 203, 204, 210, 210.1, 211, 61.1, 383/61.2

See application file for complete search history.

(56) References Cited

U.S. PATENT DOCUMENTS

| | | | |
|---|---|---|---|
| 2,379,934 | A | 7/1945 | Seiferth |
| 2,978,769 | A | 4/1961 | Harrah |
| 3,120,336 | A | 2/1964 | Whatley, Jr. |
| 3,145,112 | A | 8/1964 | Boegershausen |
| 3,181,583 | A | 5/1965 | Lingenfelter |
| 3,216,832 | A | 11/1965 | King |
| 3,398,876 | A | 8/1968 | Ward |
| 3,454,158 | A | 7/1969 | Tigner |
| 3,473,589 | A | 10/1969 | Gotz |
| 3,490,576 | A | 1/1970 | Alessi et al. |
| 3,516,537 | A | 6/1970 | Dreyfus et al. |
| 3,625,270 | A | 12/1971 | Skendzic |
| 3,647,485 | A | 3/1972 | Seiferth et al. |
| 3,676,159 | A | 7/1972 | Fallowfield |
| 3,740,237 | A | 6/1973 | Grindrod et al. |
| 3,746,215 | A | 7/1973 | Ausnit et al. |
| 3,792,181 | A | 2/1974 | Mahaffy et al. |
| 3,827,472 | A | 8/1974 | Uramoto |

(Continued)

FOREIGN PATENT DOCUMENTS

| | | |
|---|---|---|
| CA | 1082142 | 7/1980 |

(Continued)

*Primary Examiner*—Drew E Becker
*Assistant Examiner*—Preston Smith
(74) *Attorney, Agent, or Firm*—Merchant & Gould P.C.

(57) ABSTRACT

An easy-open package for food items, such as sausages, and a packaged sausage product that is hermetically sealed within a cavity. The package includes first and second sheets. The first sheet defines a cavity for holding sausages. The second sheet is applied onto the first sheet to cover the cavity and the sausages. A radiant seal seals the sausages within the cavity. A peel seal surrounds the radiant seal. In packages having a reclosable seal, one or more unsealed pockets are defined between the peel seal and a bottom of the reclosable seal, such as interlocking grooves or a zipper. The radiant and peel seals define an unsealed area. The one or more unsealed pockets and the unsealed area make it easier to open the package, by requiring less force to separate the first and second sheets. Further, the unsealed area can provide an area in which purge from the sausages is collected so that the purge is not dispersed throughout the package, thus providing a more visually appealing package.

55 Claims, 10 Drawing Sheets

U.S. PATENT DOCUMENTS

| | | | | |
|---|---|---|---|---|
| 3,910,410 | A | 10/1975 | Shaw | |
| 3,991,801 | A | 11/1976 | Ausnit | |
| 4,212,337 | A | 7/1980 | Kamp | |
| 4,246,288 | A | 1/1981 | Sanborn, Jr. | |
| 4,273,815 | A | 6/1981 | Gifford et al. | |
| 4,285,376 | A | 8/1981 | Ausnit | |
| 4,290,467 | A | 9/1981 | Schmidt | |
| 4,337,889 | A | 7/1982 | Moertel | |
| 4,367,742 | A | 1/1983 | Ornstein | |
| 4,382,513 | A | 5/1983 | Schirmer et al. | |
| 4,427,705 | A | 1/1984 | Wyslotsky et al. | |
| 4,578,813 | A | 3/1986 | Ausnit | |
| 4,603,537 | A | 8/1986 | Pace | |
| 4,617,683 | A | 10/1986 | Christoff | |
| 4,637,061 | A | 1/1987 | Riese | |
| 4,637,063 | A | 1/1987 | Sullivan et al. | |
| 4,698,954 | A | 10/1987 | Behr et al. | |
| 4,729,476 | A | 3/1988 | Lulham et al. | |
| 4,736,450 | A | 4/1988 | Van Erden et al. | |
| 4,759,642 | A | 7/1988 | Van Erden et al. | |
| 4,777,054 | A | 10/1988 | Greenhouse | |
| 4,782,951 | A | 11/1988 | Griesbach et al. | |
| 4,786,190 | A | 11/1988 | Van Erden et al. | |
| 4,823,961 | A | 4/1989 | Griesbach et al. | |
| 4,859,514 | A | 8/1989 | Friedrich et al. | |
| 4,875,587 | A | 10/1989 | Lulham et al. | |
| 4,901,505 | A | 2/1990 | Williams, Jr. | |
| 4,923,309 | A | 5/1990 | Van Erden | |
| 4,966,470 | A | 10/1990 | Thompson et al. | |
| 5,005,707 | A | 4/1991 | Hustad et al. | |
| 5,014,856 | A | 5/1991 | Griesbach et al. | |
| 5,023,121 | A | 6/1991 | Pockat et al. | |
| 5,024,044 | A | 6/1991 | Friedrich et al. | 53/433 |
| 5,050,736 | A | 9/1991 | Griesbach et al. | |
| 5,074,416 | A | 12/1991 | Hustad | |
| 5,107,658 | A | 4/1992 | Hustad et al. | |
| 5,118,203 | A | 6/1992 | Andronico | |
| 5,246,720 | A | 9/1993 | Buchko | 426/106 |
| 5,395,632 | A | 3/1995 | Lawless et al. | |
| 5,405,629 | A | 4/1995 | Marnocha et al. | |
| 5,445,838 | A | 8/1995 | Lipinski et al. | |
| 5,456,928 | A | 10/1995 | Hustad et al. | 426/87 |
| 5,582,853 | A | 12/1996 | Marnocha et al. | |
| 5,604,000 | A | 2/1997 | May | |
| 5,770,249 | A | 6/1998 | Mello et al. | |
| 5,820,904 | A | 10/1998 | Mello et al. | |
| 5,924,795 | A | 7/1999 | Thompson et al. | |
| 6,270,257 | B1 | 8/2001 | Yeager | |
| 6,347,885 | B1 | 2/2002 | Buchman | |
| 6,360,513 | B1 | 3/2002 | Strand et al. | |
| 6,461,043 | B1 | 10/2002 | Healy et al. | |
| 6,474,866 | B2 | 11/2002 | Buchman | |
| 6,499,878 | B1 | 12/2002 | Dobreski et al. | |
| 6,630,237 | B2 | 10/2003 | Rivett et al. | |
| 6,712,510 | B2 | 3/2004 | Schneider et al. | |
| 7,247,329 | B2 * | 7/2007 | Mattisson | 426/108 |
| 2001/0017947 | A1 | 8/2001 | Strand et al. | |
| 2002/0081043 | A1 | 6/2002 | Bruno | |
| 2003/0072852 | A1 | 4/2003 | Strand et al. | |
| 2003/0096042 | A1 | 5/2003 | Strand et al. | |
| 2004/0026423 | A1 | 2/2004 | Cappel et al. | |
| 2004/0058039 | A1 | 3/2004 | Strand et al. | |
| 2004/0151811 | A1 | 8/2004 | Mattisson | |

FOREIGN PATENT DOCUMENTS

| | | | |
|---|---|---|---|
| EP | 2546481 | | 5/1983 |
| EP | 0239319 | | 9/1987 |
| EP | 0239319 | B1 | 9/1990 |
| EP | 0 456 277 | A2 | 11/1991 |
| EP | 0456277 | A2 | 11/1991 |
| FR | 1551228 | | 11/1967 |
| FR | 1551228 | | 11/1968 |
| FR | 2302247 | | 2/1976 |
| FR | 2302247 | | 10/1976 |
| FR | 2546481 | | 11/1984 |
| FR | 002546481 | A1 | 11/1984 |
| GB | 620354 | | 8/1947 |
| GB | 620354 | | 3/1949 |
| GB | 1246415 | | 9/1971 |
| GB | 2094265 | | 9/1982 |
| GB | 2094265 | A | 9/1982 |

* cited by examiner

EASY-OPEN SAUSAGE PACKAGE

FIELD OF THE INVENTION

The invention relates to plastic packages for food items, more particularly, to a reclosable, plastic package for sausages that includes a hermetic peel seal, one or more unsealed sections to facilitate opening of the package and a closure mechanism that allows the package to be reclosed after it has been opened.

BACKGROUND

Various types of packages have been used to store sausages, e.g., Eckrich brand smoked sausages, which are available from ConAgra Foods Packaged Foods Co., Inc. Smoked sausages can have curved or straight shapes. One previously known package of smoked sausages includes two curved sausage pieces or links, which are held in a cavity between two plastic sheets attached by a continuous radiant seal (formed by heat and vacuum). A contact or peel seal (formed by heat and pressure) surrounds the radiant seal. In use, a consumer opens the top of the package to gain access to the sausages. These seals are typically continuous. Opening the package, however, can be difficult given the manner in which the plastic sheets are sealed together. Sometimes, the consumer will be able to manually open the top of the package with minimal damage to the package. Other times, however, the consumer must resort to cutting implements, such as scissors and knives, in order to break the radiant seal and open the package.

Once the package is finally opened, it may be damaged or destroyed as a result of tearing and/or cutting the package to access the sausages. Consequently, the opened package may not be suitable for further use. To the extent that the opened package can be salvaged, known sausage packages typically do not provide a closure mechanism that allows sausages to be saved in the package for later consumption. As a result, any remaining sausages are typically stored in the opened or torn bag, for example, by folding over the plastic top to close the top of the package. Extra sausages may also be stored in a separate container. These extra storage steps and containers present unnecessary inconveniences to a consumer, and the sausages may spoil if they are not properly packaged.

In addition to the inconveniences involved with opening sausage packages, the appearance of known sausage packages can also be improved. More particularly, when using known sealing techniques, purge or juices from the sausages is squeezed through various portions of the package, and are visible to consumers through the clear plastic sheets, thus providing a sausage package that is not particularly visually appealing due to the distributed purge.

Other known packages have been designed with particular sealing configurations for food items other than sausages. For example, Application Publication No. 2004/0151811 A1 describes a package for pizza. The package has a double seal that is formed by an inner or first seal and an outer or second seal. The two seals are separated by one or more gaps. The application explains that this double seal configuration provides an improved hermetic package to reduce the frequency of package failures.

A double seal is sometimes used in these types of packages to protect against the development of a channel or leak, but a single seal may be sufficient if it is applied properly. The pizza package that is described in the published application, however, is not designed for sausages and sausages having arcuate shapes. Additionally, the pizza package that is described does not address confining or collecting purge or juices from sausages within a particular area to provide a more visually appealing sausage package.

Accordingly, there exists a need for an improved package for sausages. The package should be easier to open than known sausage packages. The package should also not be damaged in order to access the sausages. Further, if necessary, it should be possible to utilize a closure mechanism to reclose an undamaged package to store any leftover sausages. The package should provide allow for more aesthetically pleasing presentation of sausages.

SUMMARY

In accordance with one embodiment, a sausage package includes a first sheet, a second sheet, a radiant seal, a peel seal, and a closure mechanism. The first sheet defines a cavity for holding a sausage. The second sheet, which can be flat, is applied over the first sheet to cover the cavity and the sausage. The radiant seal is formed between the first and second sheets to seal the sausage in the cavity, and the peel seal is formed between the first and second sheets and around the radiant seal. A reclosable seal extends across the tops of the first and second sheets and above the peel seal. One or more unsealed pockets are defined between the peel seal and a bottom of the reclosable seal to facilitate opening of the package. After the package is opened, it may be re-closed.

In accordance with a further embodiment, a package for a plurality of sausages includes first and second sheets, radiant and peel seals, and a reclosable seal. The first sheet defines a cavity for holding the sausages, and the second sheet is applied over the first sheet to cover the cavity and the sausages. The radiant seal is formed between the first and second sheets to seal the sausages in the cavity, and the peel seal is formed between the first and second sheets and around the radiant seal. The reclosable seal extends across the tops of the first and second sheets and above the peel seal. One or more unsealed pockets are defined between the peel seal and a bottom of the reclosable seal. Further, an unsealed area is defined between the radiant seal and the peel seal. The one or more unsealed pockets and the unsealed area facilitate opening of the package, which can be re-closed with the reclosable seal after the peel and radiant seals are broken.

In accordance with a further alternative embodiment, a package for a plurality of curved or arcuate sausages includes first and second sheets, radiant and peel seals, and a reclosable seal. The sheets define a package having a length that is different from its height. The first sheet defines a cavity for holding the arcuate sausages, and the second sheet is applied over the first sheet to cover the cavity and the arcuate sausages. The radiant seal is formed between the first and second sheets to seal the arcuate sausages in the cavity, and the peel seal is formed between the first and second sheets and around the radiant seal. The peel seal includes left, central and right sections. The left and right peel seal sections extend downwardly from the central peel seal section to opposite sides of the package. One or more unsealed pockets are defined between the peel seal and a bottom of the reclosable seal, and an unsealed area is defined between the central peel seal section and the radiant seal. The one or more unsealed pockets and the unsealed area facilitate opening of the package, which can be re-closed with the reclosable seal.

Other embodiments are directed to an easy-open package for food items that includes one or more unsealed areas but does not include a reclosable seal. According to one embodiment, a package for a food item includes first and second sheets and radiant and peel seals. The first sheet defines a cavity for holding the food item, and the second sheet is applied over the first sheet. The radiant seal is formed between the first and second sheets to seal the food item in the cavity, and the peel seal is formed around the radiant seal. One or more unsealed pockets are defined above a portion of the peel seal that extends across the width of the package, the one or more unsealed pockets facilitating opening of the package. Further, in an alternative embodiment, an unsealed area is defined between a central peel seal section and the radiant seal.

In various embodiments, an unsealed area is defined between the radiant seal and the peel seal. The top of the unsealed area can be defined by the peel seal, the bottom can be defined by the radiant seal, and the sides can be defined by both the radiant and peel seals. The unsealed portion may be located in a central or other portion of the package. Depending on the number and configuration of unsealed pockets, the unsealed area can be below a portion of the unsealed pocket, between portions of an unsealed pocket, or between two separate unsealed pockets. The unsealed pockets can also have various shapes, e.g., a rectangle, a square, a circle, a triangle, or a quadrilateral.

Further, in various embodiments, a peel seal includes right, left and central sections. The left and right peel seal sections extend downwardly, e.g., at an angle of about 30 degrees, from the central peel seal section to opposite sides of the package. Further, material that is used to form the peel seal can extend laterally between a central peel seal section and opposite sides of the package. Each segment of the laterally extending peel seal material defines at least one unsealed channel.

BRIEF DESCRIPTION OF THE DRAWINGS

Referring now to the drawings, in which like reference numbers represent corresponding parts throughout, and in which.

DETAILED DESCRIPTION OF ILLUSTRATED EMBODIMENTS

In the following description, reference is made to the accompanying drawings which form a part hereof, and which show by way of illustration specific embodiments. It is to be understood that structural changes may be made without departing from the scope of embodiments.

The present invention addresses the shortcomings of known sausage packages by providing a package or pouch that holds one or more sausage links in a cavity formed between two sheets that are sealed in such a manner that reduces the force required to open the package while, at the same time, maintaining the integrity of the package so that it can be re-closed. Sausages are sealed within a cavity formed in a packaging sheet with a radiant seal that is formed using heat and vacuum (radiant seal). A peel or contact seal that is formed using heat and pressure (peel seal) extends around the radiant seal and the cavity. One or more unsealed pockets or voids are defined between a top of the peel seal and a bottom of a closure mechanism or reclosable seal, such as interlocking ribs/grooves or a zipper, which extends across the tops of the sheets. There is only one hermetic peel seal separating the sausages and the closure mechanism, which is sufficient when known sealing technology is properly implemented. A consumer can open the pouch more easily since it is easier to break seals through one or more unsealed pockets and an unsealed area compared to a solid seal. Further, an unsealed area is defined between the peel and radiant seals. In addition to reducing the peeling force that is required to open the package, the unsealed area serves to collect and confine purge, thus providing a more visually appealing package.

The consumer initially removes a tamper-evident tear strip at the top of the package, opens the closure mechanism and separates the top edges of the package sheets adjacent the closure mechanism, continuing to break through the one or more unsealed pockets defined between the peel seal and the closure mechanism and to break through the unsealed area defined between the peel and radiant seals, until the peel and radiant seals are broken to gain access to the sausages. The sausages are accessed without damaging the package, which can be re-closed with a closure mechanism to store any unused sausages for later consumption. FIGS. 1-9 illustrate easy-open packages that embody aspects of the invention in further detail.

Figure 1:
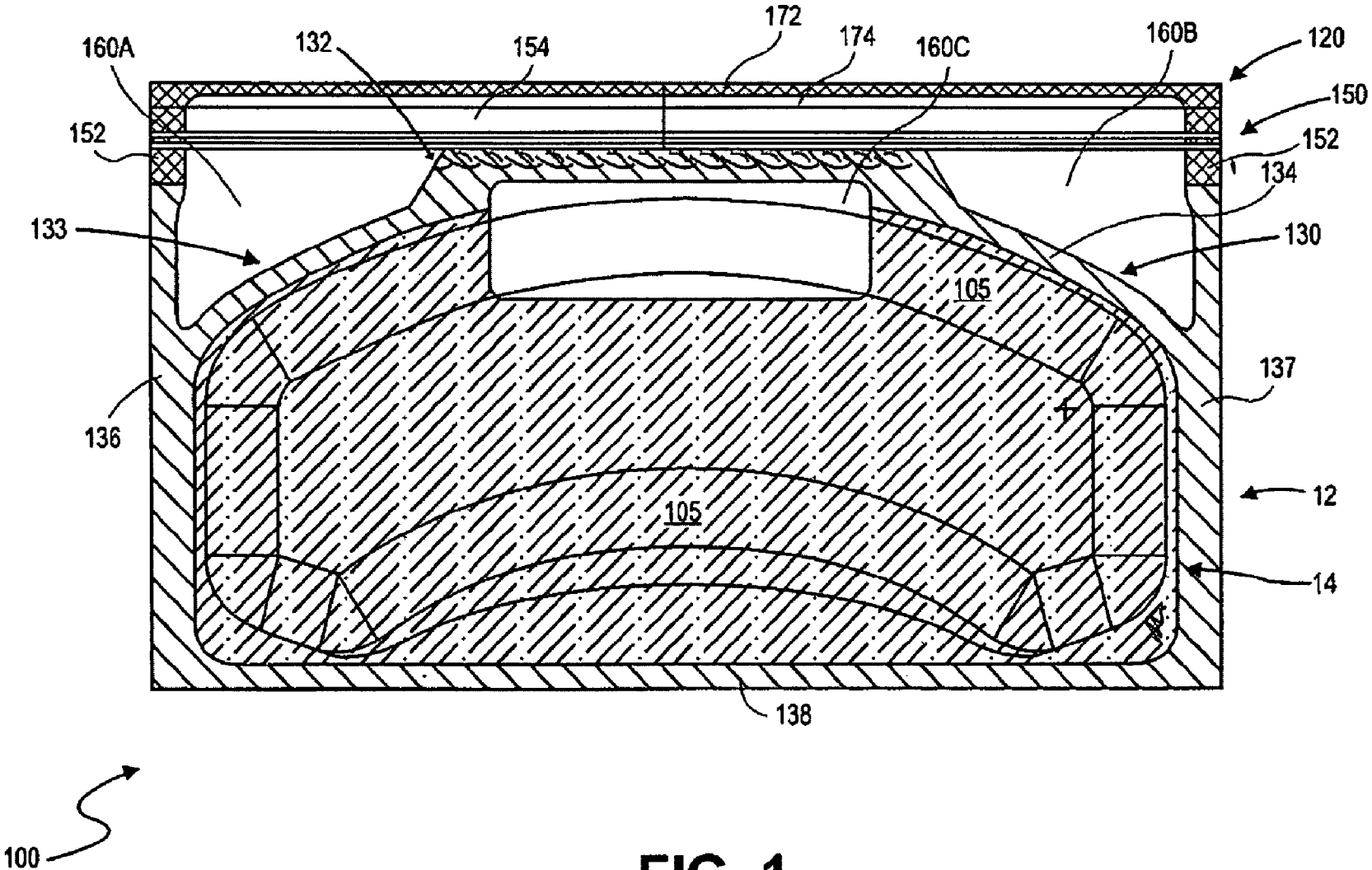
FIG. 1 illustrates one embodiment of the invention in the form of a sausage package having a single, continuous hermetic peel seal surrounding a radiant seal, two unsealed pockets between the peel seal and a closure mechanism, and an unsealed area between the radiant and peel seals.

In FIG. 1, according to one embodiment, a package 100 for one or more sausages 105 includes a first plastic sheet 110, a second plastic sheet 120, a peel or contact seal 130, a radiant seal 140 and a closure mechanism 150. The illustrated embodiments are shown with reference to curved cylindrical sausages. For typical sausage links, the package 100 can be, for example, from about 285 mm to about 300 mm in width, and from about 155 mm to about 170 mm in height. Thus, the package 100 can have a width that is greater than its height to accommodate the shape and size of the sausages 105. Persons skilled in the art will appreciate that embodiments can be adapted to sausages having different shapes and sizes. For purposes of illustration, not limitation, this specification refers to curved sausages.

Figure 2:
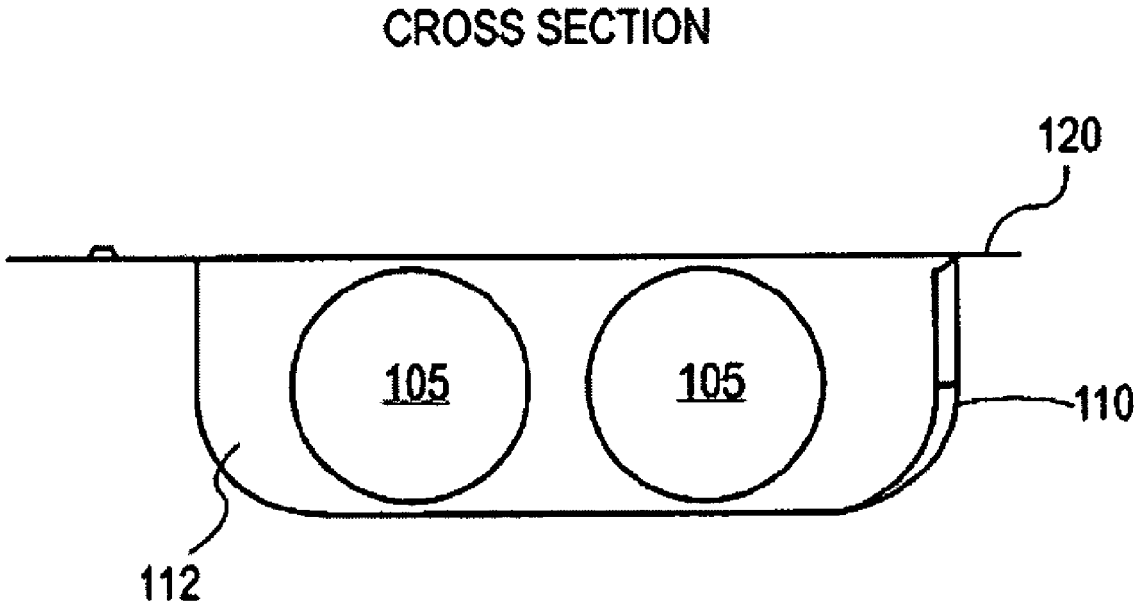
FIG. 2 illustrates a cross-sectional view of a package.
Figure 3:
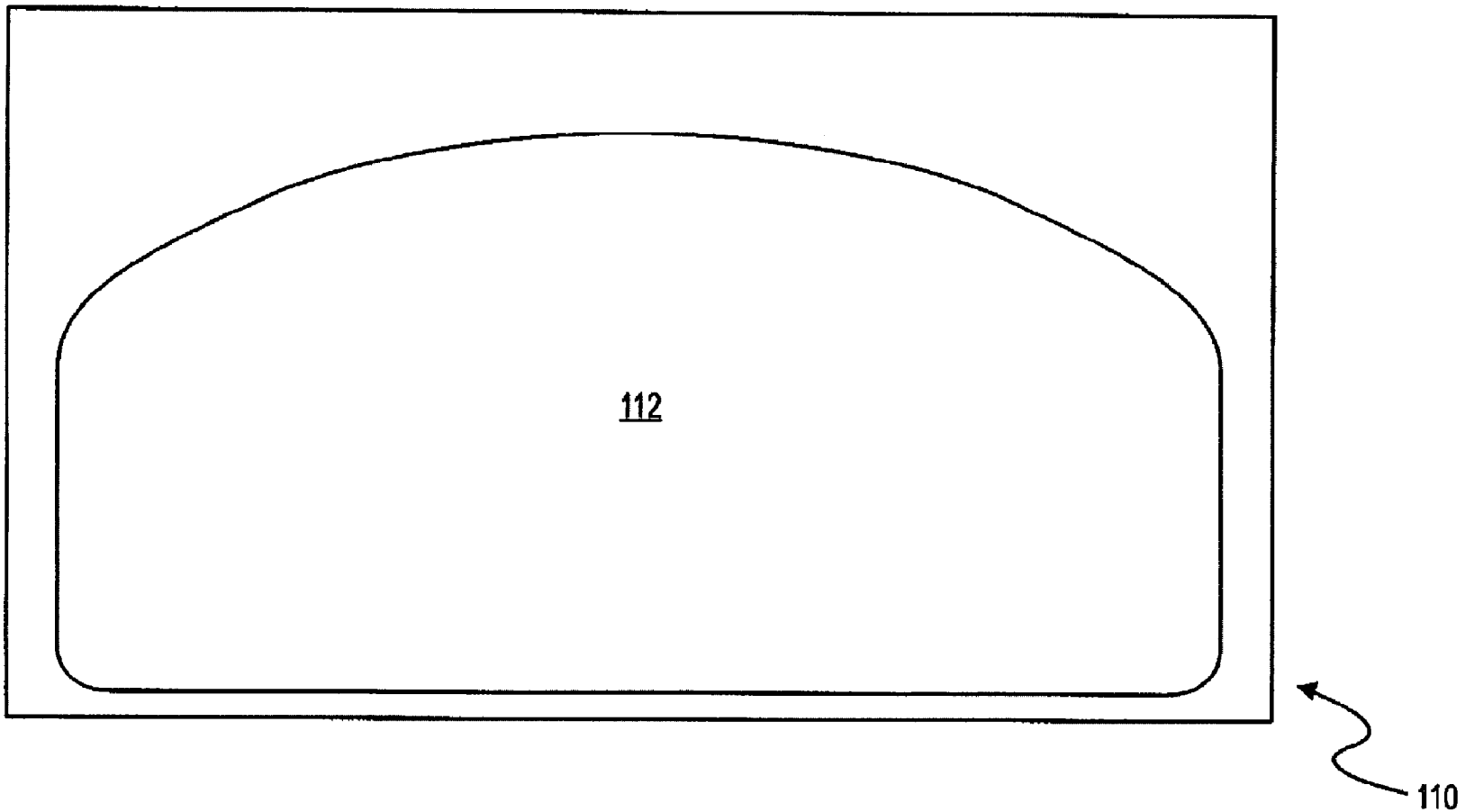
FIG. 3 illustrates a first or bottom sheet of a sausage package.
Figure 4:
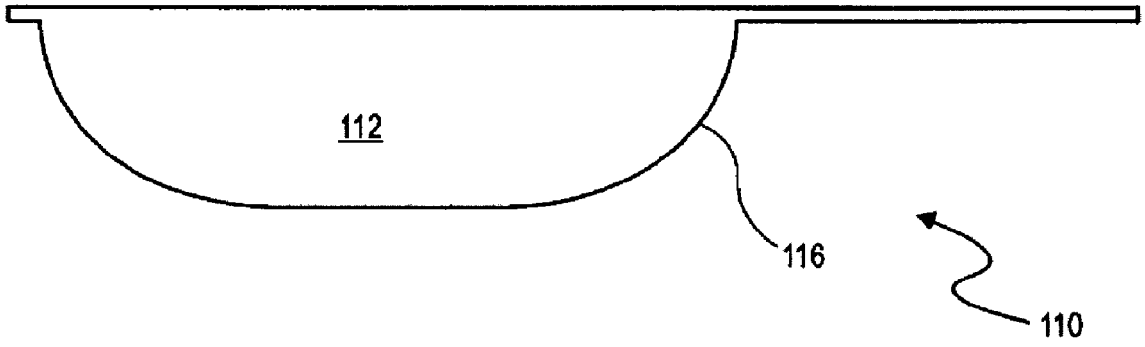
FIG. 4 illustrates a side view the first sheet shown in FIG. 3.
Figure 5:
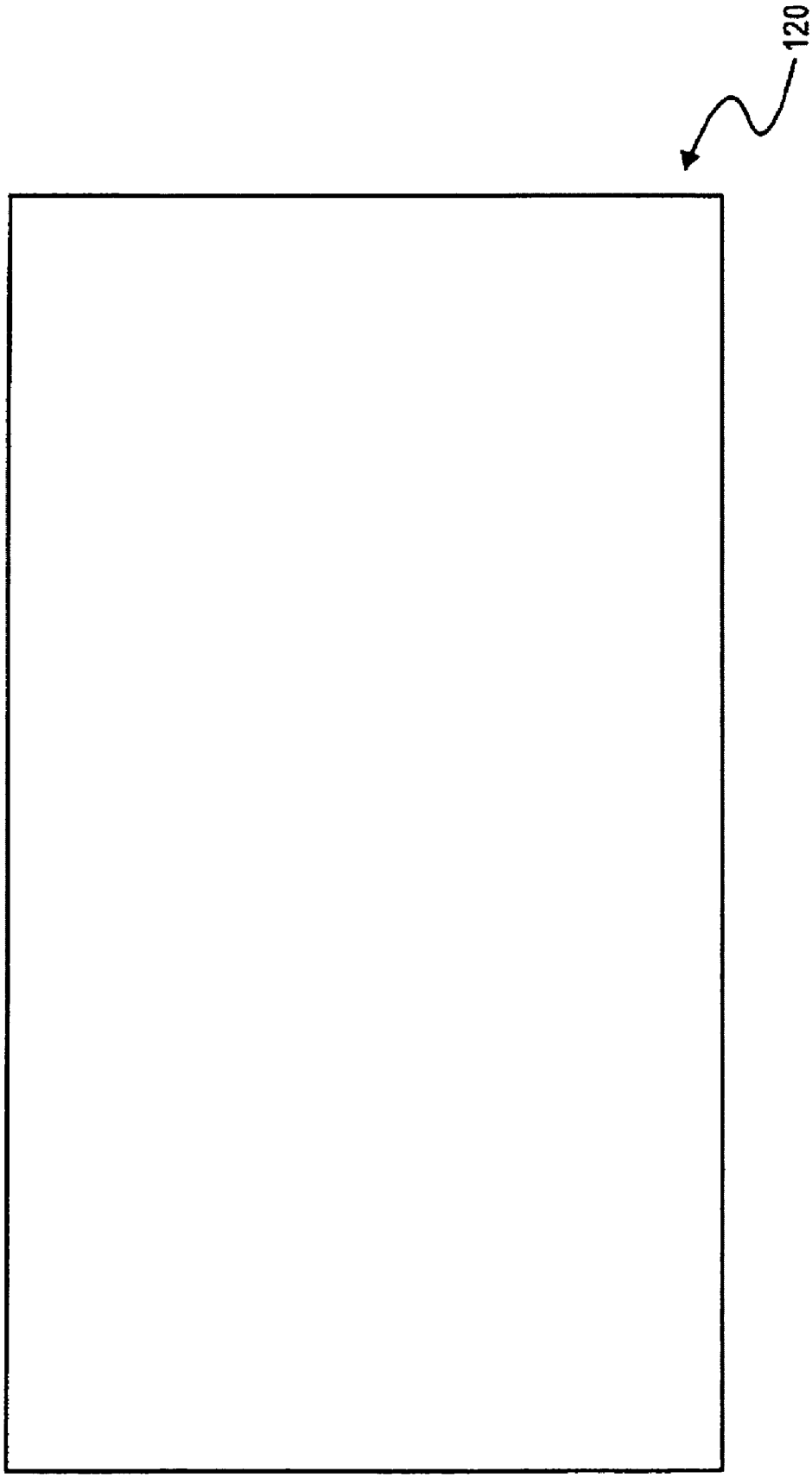
FIG. 5 illustrates a flat second sheet that covers the first or bottom sheet shown in FIGS. 3 and 4.
Figure 6:
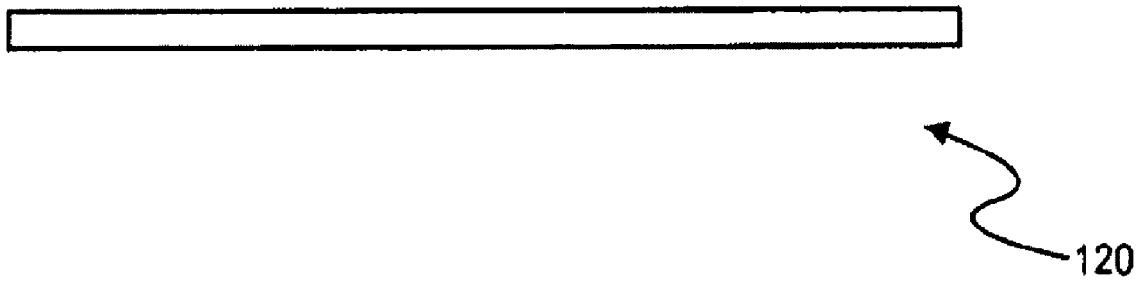
FIG. 6 illustrates a side view of the flat second shown in FIG. 5.

Referring to FIGS. 2-4, the first or bottom plastic sheet 110 is ridged or semi-ridged and defines a pocket or cavity 112 ("cavity") for holding sausages 105. The bottom plastic sheet 110 may be, for example, a peelable polyester barrier that is laminated with polypropylene. Referring to FIGS. 2, 5 and 6, the second sheet 120 is a flat plastic sheet that may be flexible and placed over the first sheet 110 to cover the cavity 112 and the sausages 105 within the cavity 112. The second plastic sheet may be, for example, a peelable oriented polyester that is laminated with a barrier sealant. After the second sheet 120 is placed over the first sheet 110, the cavity 112 having the sausages 105 is sealed with a radiant seal 140.

Referring again to FIG. 1, the radiant seal 140 is above the cavity 112 and seals the sausages 105 within the cavity 112. The hermetic peel or contact seal 130 is continuous and is formed around the radiant seal 140 between the bottom of the package 100 and the bottom of the closure mechanism 150. The peel seal 130 can be formed using an appropriately shaped seal bar. The seal bar applies heat and pressure in a pattern of the peel seal 130. For example, a peel seal 130 can be formed by pressing a seal bar at a temperature of about 125° C. for about one second over the first and second sheets 110 and 120. In an exemplary package 100 having a width of about 285 mm and a height of about 155 mm, the peel seal 130 can have a height or thickness of about 5-7 mm. The peel seal 130 is preferably at least 5 mm in width to provide sufficient strength and hermetic sealing capability, but is not so wide so as to unduly hinder opening of the package 100. For example, according to one preferred embodiment, the peel seal 130 has a strength of about 2.5-3.3 pounds per square inch (psi) so that it can be broken by hand by a consumer with a relatively small amount of force. The entire peel seal is thus temporary and can be broken by hand.

The manner in which the first and second sheets 110 and 120 are sealed together defines unsealed pockets or voids 160*a* and 160*b* (generally, "pockets"). More particularly, in the illustrated embodiment, the peel seal 130 extends across the width of the package above the radiant seal 140, preferably around the outer periphery of the radiant seal 140. The peel seal 130 is continuous and includes central peel seal section 132, left and right peel seal sections 133 and 134 that extend downwardly from the central peel seal section 132 and that follow the contour of the radiant seal 140, side peel seal sections 136 and 137 and a bottom peel seal section 138. The left and right peel seal sections 133 and 134 extend downwardly from the central peel seal section 132 at an angle of about 30 degrees to opposite sides of the package. Persons skilled in the art will appreciate that the slope or curvature of the left and right peel seal sections 133 and 134 can vary depending on the number, shapes and sizes of sausage products. Peel seal sections 136 and 137 extend along the sides of the package between the bottom of the closure mechanism 150 and the bottom of the package 100.

In the illustrated embodiment, the central peel seal section 132 extends between the bottom of the closure mechanism 150 and the top of radiant seal 140, thus defining two separate unsealed pockets 160*a* and 160*b* in the upper corners of the package 100. The unsealed pockets 160*a* and 160*b*, and partially conforming to the shape of the cavity 112, the sausages 105 and/or the radiant seal 140. In the exemplary illustrated embodiment, the unsealed pockets 160*a* and 160*b* are advantageously substantially triangular in shape and symmetrical. Unsealed pockets having different shapes and sizes may, however, result from different package configurations that are within the scope of the invention. For example, in an alternative embodiment shown in FIG. 9, a package 900 includes unsealed pockets 160*a* and 160*b* that have different shapes and/or sizes, i.e., they are asymmetrical. Asymmetrical unsealed pockets can be formed by using peel seal sections having different shapes.

In addition to the unsealed pockets 160*a* and 160*b*, an unsealed area 160*c* is defined between the radiant seal 140 and the peel seal 130. Although all of sections 160*a-c* are unsealed, for purposes of identifying different unsealed sections, unsealed sections 160*a* and 160*b* that are defined between a top of the peel seal 130 and the closure mechanism 150 are referred to as unsealed "pockets," and the unsealed section 160*c* that is defined between the peel and radiant seals 130 and 140 is referred to as an unsealed "area."

The unsealed area 160*c*, like the unsealed pockets 160*a* and 160*b*, allows the package to be opened more easily since it is easier to tear through unsealed sections compared to complete or continuous seals. An added benefit of the unsealed area 160*c* is that purge from the sausages can be collected in the unsealed area 160*c*, thus providing a package that is more visually appealing to consumers.

As shown in FIG. 1, the unsealed area 160*c* is defined between the radiant seal 140 and the peel seal 130 and between two unsealed pockets 160*a* and 160*b*. A bottom of the unsealed area 160*c* is defined by the radiant seal 140. The top of the unsealed area 160*c* is vertically defined between the bottom of the closure mechanism 150 and the top of the peel seal 130. The sides of the unsealed area 160*c* and defined by section of both the peel and radiant seals 130 and 140. The unsealed area 160*c* is illustrated having a rectangular shape, but can also have other shapes and sizes. For example, other unsealed area shapes can include squares, circles, triangles, and quadrilaterals. Further, the unsealed area can be positioned in different locations rather than being within a central portion of the package, depending on the particular packaging applications. Thus, a central, rectangular unsealed area 160*c* is provided for purposes of explanation and illustration, not limitation.

The closure mechanism 150 is positioned above the peel seal 130. In the illustrated embodiment, the closure mechanism 150 can be interlocking ribs/grooves, as illustrated in FIG. 1, or a zipper, as is known in the art. The ends 152 of the closure mechanism 150 are crushed and are of sufficient strength so that when the package is opened, the crushed ends 152 prohibit the temporary side and bottom peel seal sections 137-138 from being broken. Thus, the top of the peel seal or sections 132-134 are broken. Portions of the side peel seals 136 and 137 may be broken when the package is opened, but the integrity of the package is maintained. A tamper evident mechanism 170 is located above the closure mechanism 150 to provide a visual indication whether the package has been opened prior to purchase. In one embodiment, the tamper evident mechanism 170 is a conventional tamper-evident tear strip 172 that is connected to flaps 154 extending upwardly from the closure mechanism 150. The tear strip is connected to the flaps 154 along perforation lines 174. The tear strip 172 is removed along the perforations 174 in order to access the closure mechanism 150 and the sausages 105, thus providing a visual indication whether or not the package has been prematurely opened.

The consumer initially removes the tamper evident strip 172 by tearing the strip 172 along the perforation 177 to access two flaps 154 above the closure mechanism. Holding the flaps 154, preferably the middle of the flaps 154, the consumer pulls the flaps 154 apart, thus separating the flaps and opening the middle of the package. Further motion opens the package further and breaks the top of the peel seal 130 and opens the pockets 160*a* and 160*b* and unsealed area 160*c*. The top of the peel seal can have a jagged edge so that tearing of the peel seal 130 can be initiated more easily. Continued motion further breaks the left and right peel seal sections 133 and 134 and the radiant seal 140, thus providing access to the sausages 105 in the cavity 112. The package is opened without damaging the package so that it can be used to store any remaining sausages. The package can be re-closed with the closure mechanism 150.

The arrangement and design of seals is advantageous and more convenient compared to many known sausage packages since a consumer is not required to separate complete or continuous seals. Rather, the seal area that must be broken is significantly reduced by providing the unsealed pockets 160*a* and 160*b* and the unsealed area 160*c*, thus reducing the amount of force that is required to open the package. Embodiments thus eliminate the need for consumers to resort to cutting implements, such as scissors and knives, to open sausage packages, making it safer and easier to open sausage packages. Moreover, the package can be opened without being damaged or destroyed. Leftover sausages can be stored in the original package, rather than wrapping them in a partially or completely destroyed package or storing them in a separate container. Further, prior to opening the package, the product purge (liquid or moisture) may be retained proximate to the sausage in the unsealed area 160*c*, thus improving the appearance of the package. Embodiments, therefore, provide significant advantages over known packages. Persons skilled in the art will appreciate that changes can be made to the embodiment shown in FIG. 1 while providing the same or similar benefits.

Figure 7:
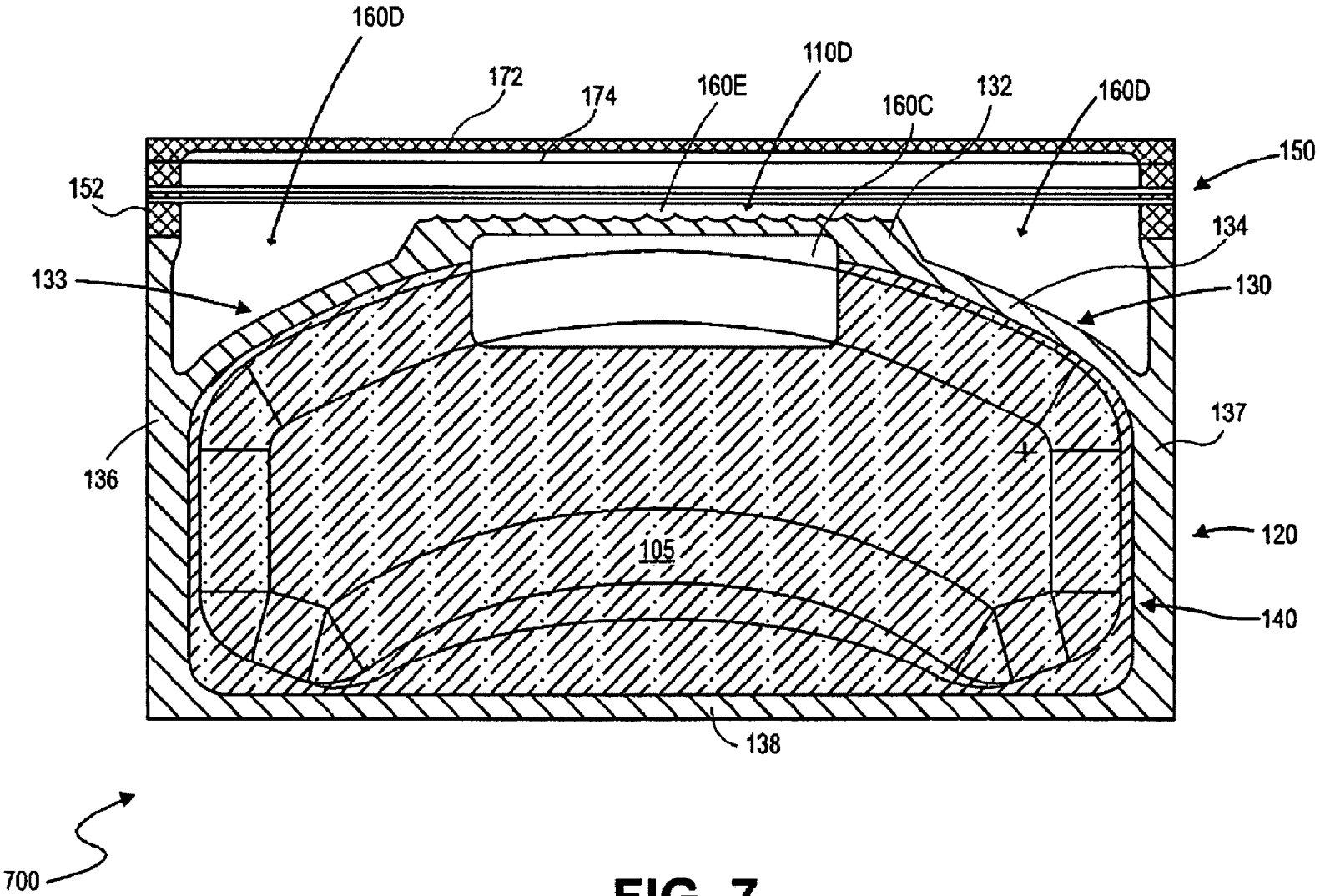
FIG. 7 illustrates another embodiment of the invention in the form of a sausage package having a single, continuous hermetic peel seal surrounding a radiant seal, one unsealed pocket between the peel seal and a closure mechanism and extending across the width of the package, and an unsealed area between the radiant and peel seals.

For example, FIG. 7 illustrates an alternative embodiment of a package 700 having a single unsealed pocket 160*d* that extends across the width of the package, rather than two separate unsealed pockets 160*a* and 160*b* as shown in FIG. 1. The single unsealed pocket 160*d* is defined between the top of the peel seal (sections 132-134) and the bottom of the closure mechanism 150. The single unsealed pocket 160*d* is formed by the central peel seal section 132 extending only partially to the bottom of the closure mechanism 150 (rather than extending completely to the bottom of the closure mechanism 150 as shown in FIG. 1), thus a gap 160*e* is formed, and a single unsealed pocket 160*d* that extends across the width of the package is defined.

In the illustrated embodiment, the unsealed pocket 160*d* has a varying height along its width and generally follows the contour of the top of the radiant seal 140 and/or sausages 105. More specifically, in the illustrated embodiment, the height of the unsealed pocket 160*d* is greater at the sides of the package compared to the section 160*e* immediately above the central peel seal section 132. The height of the unsealed section 160*e* immediately above the central peel seal section 132 can be about 3 mm, and the height of the unsealed section near the sides of the package can be about 3 mm. Other aspects of the package 700 are the same as the package 100 shown in FIG. 1 and described above.

Figure 8:
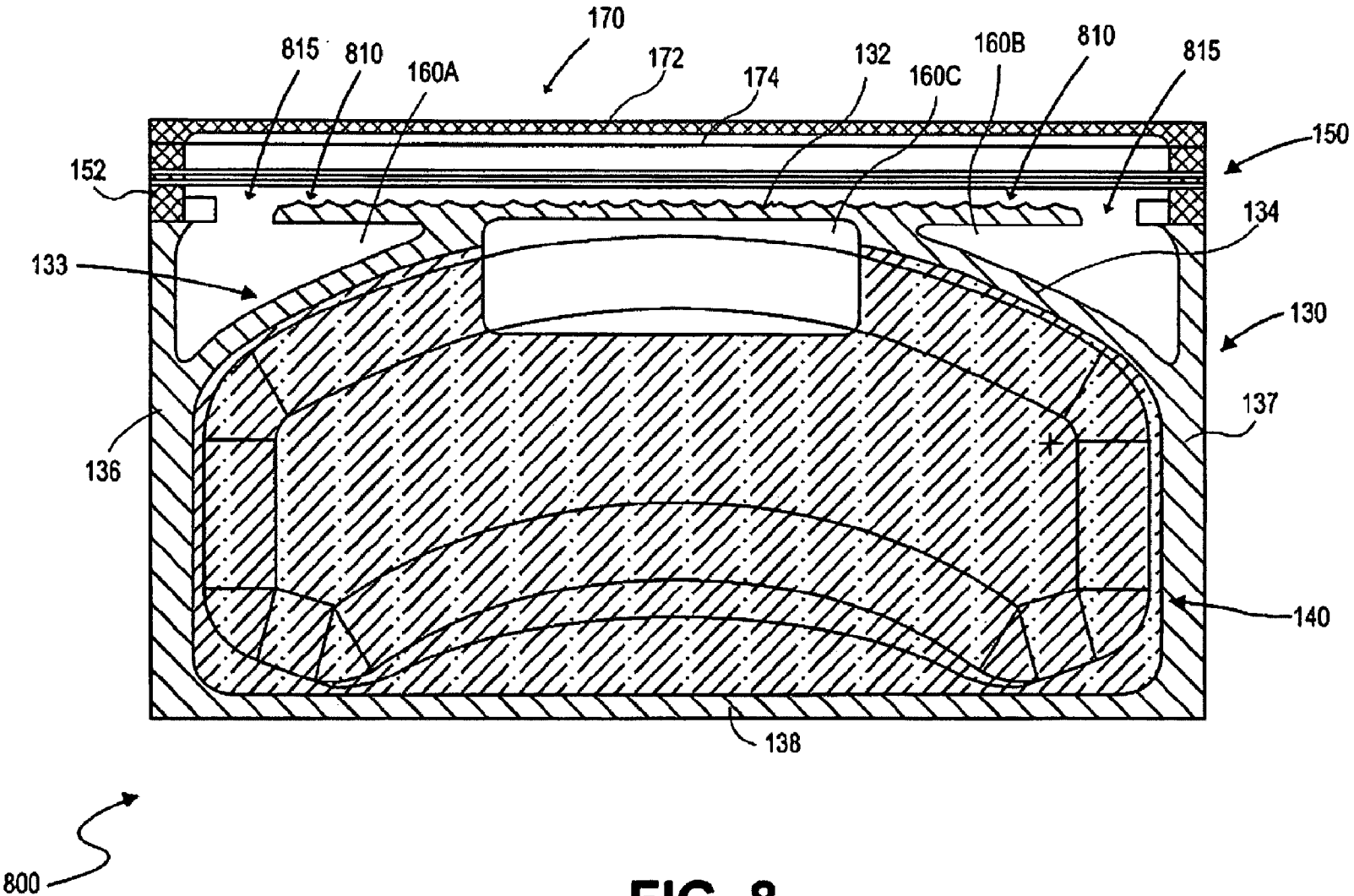
FIG. 8 illustrates an alternative embodiment of the invention in the form of a sausage package having a single, continuous hermetic peel seal, two unsealed pockets, an unsealed area, and a section of peelable material extending between the peel seal and sides of the package that defines one or more gaps or unsealed channels.
Figure 9:
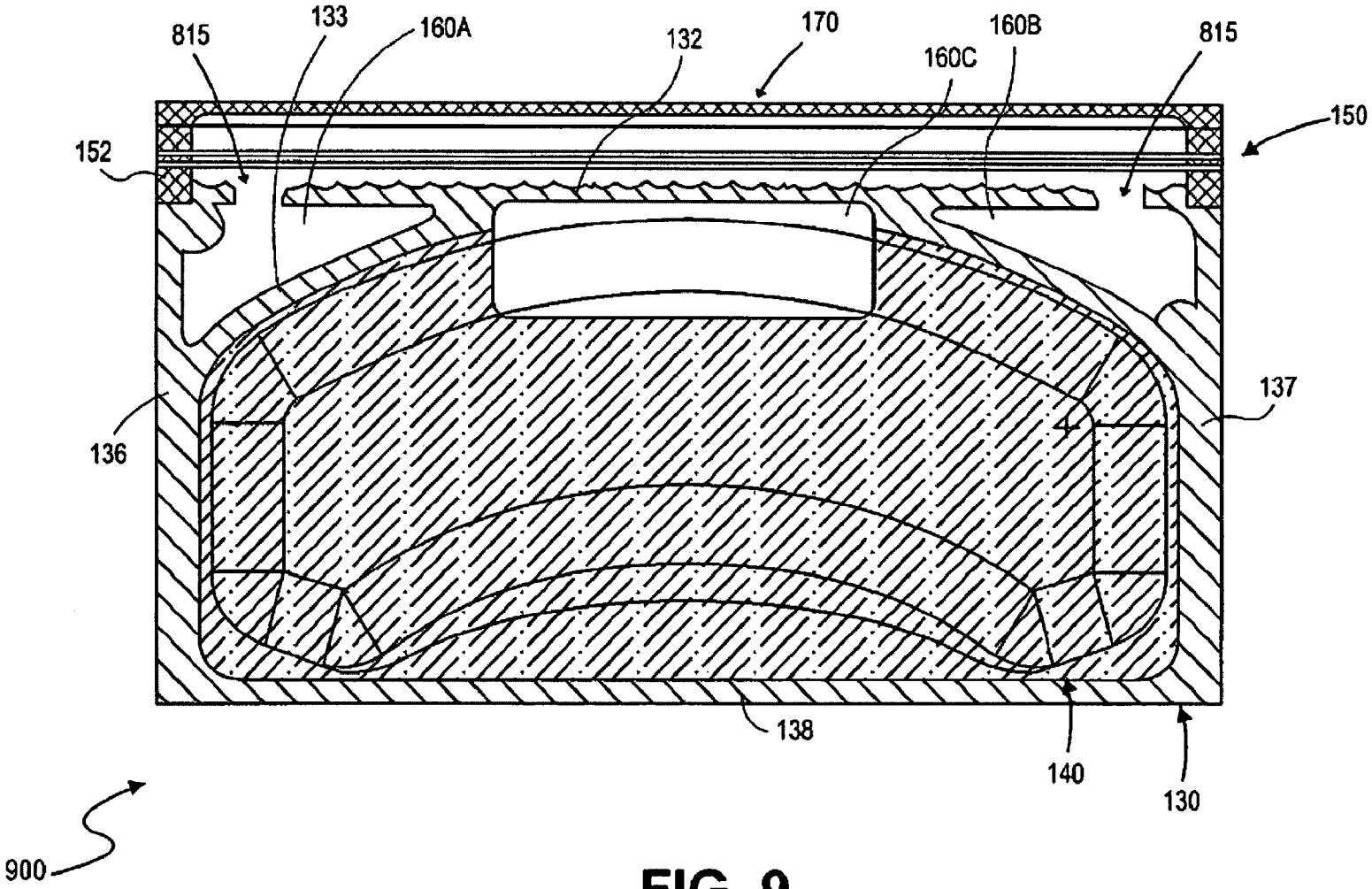
FIG. 9 illustrates an alternative embodiment of the invention in the form of a package having asymmetrical unsealed pockets formed by peel seal sections having different shapes.

Referring to FIG. 8, in a further alternative embodiment, a package 800 is the same as the package shown in FIG. 1, except that the package 800 includes additional segments of material extending from the central peel seal section. More particularly, the package 800 includes sections of peelable material 810 that extend laterally from a central peel seal section 132 to opposite sides of the package. The material 810 defines one or more channels 815 and, therefore, does not form a seal. In one embodiment, the strip of material 810 has a height or thickness of about 3 mm, and the channel 815 can have a width of about 2 mm. The material 810 may be useful for providing further rigidity to the top of the package if it is needed. The material 810 may also provide a symmetrical appearance across the width of the package below the closure mechanism 150. The material strip 810 and channel 815 may have other shapes and sizes depending on various packaging applications. Other aspects of the package are the same as the package shown in FIG. 1 and described above.

Figure 10:
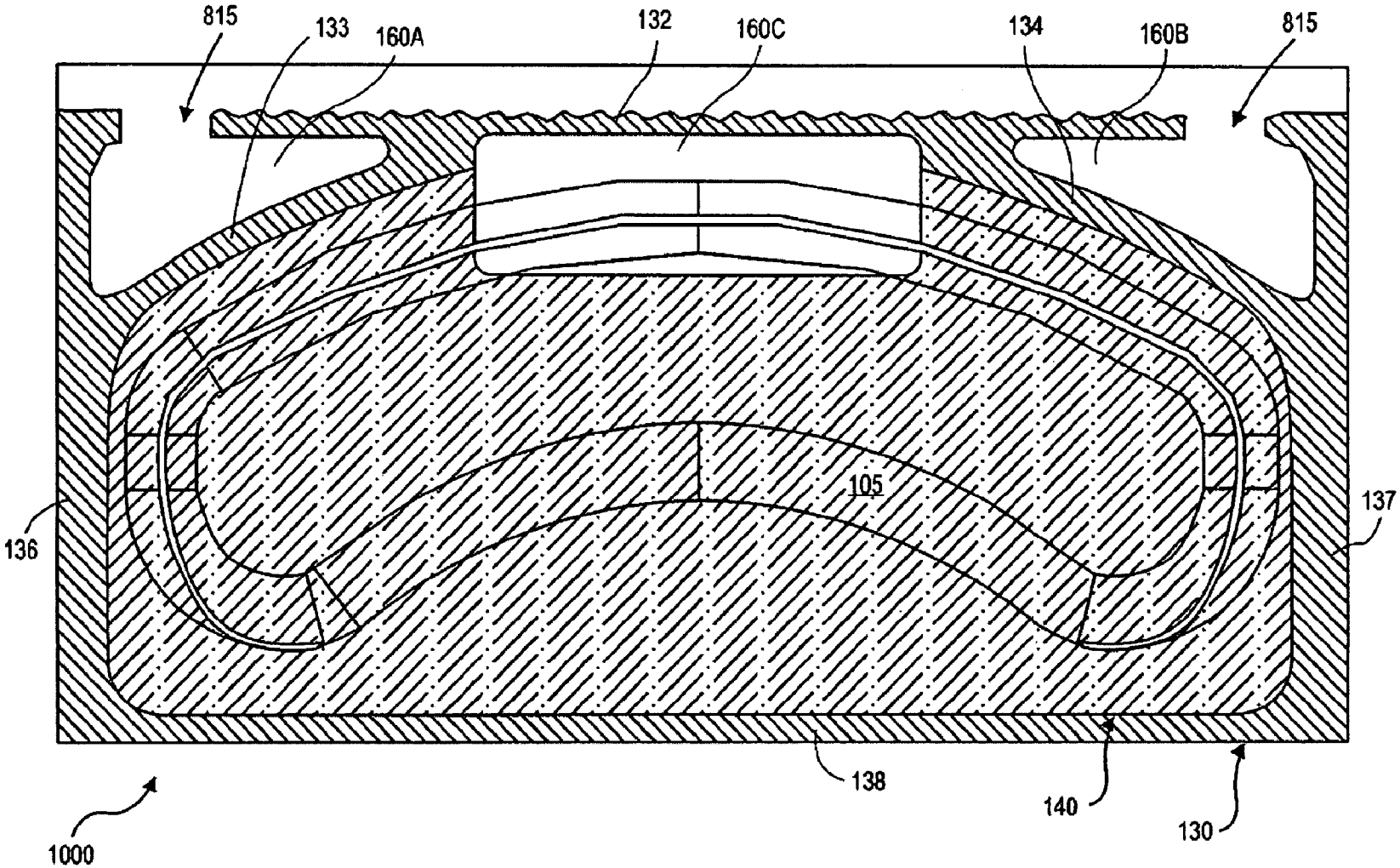
FIG. 10 illustrates an alternative embodiment of the invention in the form of a package having one or more unsealed pockets and an unsealed area, but not a closure mechanism.

In alternative embodiments, an easy-open. package may not require a reclosure mechanism. For example, referring to FIG. 10, a package 1000 is designed in a manner that is similar to the package 800 shown in FIG. 8, except that the closure mechanism 150 and temper evident mechanism are removed. Instead, the tops of the sheets 110 and 120 are initially closed by a contact seal.

Although references have been made in the foregoing description to various embodiments, persons skilled in the art will recognize that insubstantial modifications, alterations, and substitutions can be made to the described embodiments without departing from embodiments as recited in the accompanying claims.

What is claimed is:

1. A package for a food item, comprising: a first sheet defining a cavity for holding the food item; a second sheet applied over the first sheet to cover the cavity and the food item; a radiant seal formed between the first and second sheets to seal the food item in the cavity; a peel seal formed between the first and second sheets around the radiant seal; and a reclosable seal extending across the tops of the first and second sheets and above the peel seal, wherein one or more unsealed pockets are defined between the peel seal and a bottom of the reclosable seal, the one or more unsealed pockets facilitating opening of the package, the package being re-closable with the reclosable seal after the peel seal and the radiant seal are broken.

2. The package of claim 1, wherein the radiant seal and the peel seal define an unsealed area there between, and the one or more unsealed pockets and the unsealed area facilitate opening of the package.

3. The package of claim 2, wherein a bottom of the unsealed area is defined by the radiant seal.

4. The package of claim 2, wherein a top of the unsealed area is defined by the peel seal.

5. The package of claim 2, wherein a side of the unsealed area is defined by the radiant seal and the peel seal.

6. The package of claim 2, wherein one unsealed pocket that extends across the width of the package is defined between the peel seal and a bottom of the reclosable seal, the unsealed area being defined in a central portion of the package and below a central portion of the unsealed pocket.

7. The package of claim 6, wherein the unsealed area is defined between opposite sides of the unsealed pocket.

8. The package of claim 2, wherein two unsealed pockets are defined between the peel seal and a bottom of the reclosable seal, the unsealed area being defined between the two unsealed pockets.

9. The package of claim 1, wherein the entire peel seal is temporary and breakable by hand.

10. The package of claim 1, wherein the peel seal extends along opposite sides of the package between the bottom of the package and the bottom of the reclosable seal.

11. The package of claim 1, wherein a central peel seal section extends to a bottom of the reclosable seal, thereby forming two unsealed pockets between the peel seal and the bottom of the reclosable seal.

12. The package of claim 11, wherein the central peel seal section extends partially to the bottom of the reclosable seal, thereby defining one unsealed pocket between the peel seal and the bottom of the reclosable seal, and wherein the unsealed pocket extends across the width of the package.

13. The package of claim 1, wherein the peel seal is the only seal between the radiant seal and the bottom of the reclosable seal.

14. The package of claim 1, wherein a central peel seal section extends laterally across a portion of the width of the package, and left and right peel seal sections adjacent the central peel seal section extend downwardly from the central peel seal section to opposite sides of the package.

15. The package of claim 14, wherein the left and right peel seal sections extend downwardly at an angle of about 30 degrees.

16. The package of claim 1, wherein the peel seal substantially follows a contour of the radiant seal.

17. The package of claim 1, comprising one unsealed pocket that extends across the width of the package.

18. The package of claim 1, wherein the unsealed pocket has a variable height along its width.

19. The package of claim 1, comprising two symmetrical unsealed pockets.

20. The package of claim 1, wherein the one or more unsealed pockets is surrounded by the peel seal and the reclosable seal.

21. The package of claim 1, wherein material that is used to form the peel seal extends laterally between a central peel seal section and opposite sides of the package, each segment of the laterally extending peel seal material defining at least one unsealed channel.

22. The package of claim 1 having a width that is greater than its height.

23. The package of claim 1, wherein the food item and a top peel seal section have an arcuate shape.

24. A packaged sausage product, comprising: one or more sausages; a first sheet defining a cavity holding the one or more sausages; a second sheet applied over the first sheet to cover the cavity and the one or more sausages; a radiant seal formed between the first and second sheets to seal the one or more sausages in the cavity; a peel seal formed between the first and second sheets and around the radiant seal; and a reclosable seal extending across the tops of the first and second sheets and above the peel seal, wherein one or more unsealed pockets are defined between the peel seal and a bottom of the reclosable seal, an unsealed area is defined between the radiant seal and the peel seal, the one or more unsealed pockets and the unsealed area facilitate opening of the package, and the package is re-closable with the reclosable seal after the peel seal and the radiant seal are broken.

25. The package of claim 24, wherein a bottom of the unsealed area is defined by the radiant seal.

26. The package of claim 24, wherein a top of the unsealed area is defined by the peel seal.

27. The package of claim 24, wherein a side of the unsealed area is defined by the radiant seal and the peel seal.

28. The package of claim 24, wherein one unsealed pocket that extends across the width of the package is defined between the peel seal and a bottom of the reclosable seal, and wherein the unsealed area is defined in a central portion of the package below a central portion of the unsealed pocket.

29. The package of claim 28, wherein the unsealed area is defined between opposite sides of the unsealed pocket.

30. The package of claim 24, wherein two unsealed pockets are defined between the peel seal and a bottom of the reclosable seal, and wherein the unsealed area is defined between the two unsealed pockets.

31. The package of claim 24, wherein the entire peel seal is temporary and breakable by hand.

32. The package of claim 24, wherein the peel seal extends along opposite sides of the package between the bottom of the package and the bottom of the reclosable seal.

33. The package of claim 24, wherein a central peel seal section extends to a bottom of the reclosable seal, thereby forming two unsealed pockets between the peel seal and the bottom of the reclosable seal.

34. The package of claim 24, wherein the central peel seal section extends partially to the bottom of the reclosable seal, thereby defining one unsealed pocket between the peel seal and the bottom of the reclosable seal, and wherein the unsealed pocket extends across the width of the package.

35. The package of claim 24, wherein the peel seal is the only seal between the radiant seal and the bottom of the reclosable seal.

36. The package of claim 24, wherein a central peel seal section extends laterally across a portion of the width of the package, and left and right peel seal sections adjacent the central peel seal section extends downwardly from the central peel seal section to opposite sides of the package.

37. The package of claim 36, wherein the left and right peel seal sections extend downwardly at an angle of about 30 degrees.

38. The package of claim 24, wherein the peel seal substantially follows a contour of the radiant seal.

39. The package of claim 24, comprising one unsealed pocket that extends across the width of the package.

40. The package of claim 39, wherein the unsealed pocket has a variable height along its width.

41. The package of claim 24, comprising two symmetrical unsealed pockets.

42. The package of claim 24, wherein the one or more unsealed pockets is surrounded by the peel seal and the reclosable seal.

43. The package of claim 24, wherein material that is used to form the peel seal extends laterally between a central peel seal section and opposite sides of the package, and wherein each segment of the laterally extending peel seal material defines at least one unsealed channel.

44. The package of claim 24 having a width that is greater than its height.

45. The package of claim 24, wherein the one or more sausages and a top peel seal section have an arcuate shape.

46. A packaged sausage product, comprising: one or more arcuate sausages; a first sheet defining a cavity holding the one or more arcuate sausages; a second sheet applied over the first sheet to cover the cavity and the one or more arcuate sausages, wherein the first and second sheets define a package having a width that differs from its height; a radiant seal formed between the first and second sheets to seal the one or more arcuate sausages in the cavity; a peel seal formed between the first and second sheets and around the radiant seal, wherein the peel seal includes left, central and right sections, wherein the left and right peel seal sections adjacent the central peel seal section extend downwardly from the central peel seal section to opposite sides of the package; and a reclosable seal extending across the tops of the first and second sheets and above the peel seal, wherein one or more unsealed pockets are defined between the peel seal and a bottom of the reclosable seal, an unsealed area is defined between the central peel seal section and the radiant seal, the one or more unsealed pockets and the unsealed area facilitate opening of the package, and wherein the package is re-closable with the reclosable seal after the peel seal and the radiant seal are broken.

47. The package of claim 46, wherein a bottom of the unsealed area is defined by the radiant seal, a top of the unsealed area is defined by the peel seal, and each side of the unsealed area being defined by the radiant and peel seals.

48. The package of claim 46, wherein the entire peel seal is temporary and breakable by hand.

49. The package of claim 46, wherein the peel seal is the only seal between the radiant seal and the bottom of the reclosable seal.

50. The package of claim 46, wherein the left and right peel seal sections extend downwardly at an angle of about 30 degrees.

51. The package of claim 46, comprising one unsealed pocket that extends across the width of the package.

52. The package of claim 46, comprising two symmetrical unsealed pockets.

53. The package of claim 46, wherein material that is used to form the peel seal extends laterally between the central peel seal section and opposite sides of the package, and wherein each segment of the laterally extending peel seal material defines at least one unsealed channel.

54. A package for a food item, comprising: a first sheet defining a cavity for holding the food item; a second sheet applied over the first sheet to cover the cavity and the food item, a radiant seal formed between the first and second sheets to seal the food item in the cavity; and a peel seal formed between the first and second sheets and around the radiant seal, wherein the peel seal has left, central and right sections, and wherein the left and right peel seal sections adjacent the central peel seal section extend downwardly from the central peel seal section to opposite sides of the package, wherein one or more unsealed pockets are defined above a portion of the peel seal that extends across the width of the package and facilitate opening of the package.

55. A package for a food item, comprising: a first sheet defining a cavity for holding the food item; a second sheet applied over the first sheet to cover the cavity and the food item, a radiant seal formed between the first and second sheets to seal the food item in the cavity; and a peel seal formed between the first and second sheets and around the radiant seal, wherein the peel seal has left, central and right sections, and wherein the left and right peel seal sections adjacent the central peel seal section extend downwardly from the central peel seal section to opposite sides of the package, wherein one or more unsealed pockets are defined above a portion of the peel seal that extends across the width of the package, and wherein an unsealed area is defined between the central peel seal section and the radiant seal, wherein the one or more unsealed pockets and the unsealed area facilitate opening of the package.

* * * * *

UNITED STATES PATENT AND TRADEMARK OFFICE

CERTIFICATE OF CORRECTION

PATENT NO. : 7,604,828 B2
APPLICATION NO. : 11/120421
DATED : October 20, 2009
INVENTOR(S) : Taylor et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1130 days.

Signed and Sealed this

Fifth Day of October, 2010

David J. Kappos

David J. Kappos
*Director of the United States Patent and Trademark Office*